US005465606A

United States Patent [19]

Janssen et al.

[11] Patent Number: 5,465,606

[45] Date of Patent: Nov. 14, 1995

[54] SYSTEM FOR MEASURING THE EFFICIENCY OF HYDROCARBON VAPOR RECOVERY INSTALLATIONS USED IN GAS STATIONS

[75] Inventors: Sylvain Janssen, Neuilly s/Seine; Jean-Pierre Campain, Clamart, both of France

[73] Assignee: Schlumberger Industries, Montrouge, France

[21] Appl. No.: 88,871

[22] Filed: Jul. 8, 1993

[30] Foreign Application Priority Data

Jul. 9, 1992 [FR] France ..... 92 08657

[51] Int. Cl.[6] ..... B67D 5/378

[52] U.S. Cl. ..... 73/23.2; 73/30.03

[58] Field of Search ..... 73/23.2, 23.31, 73/30.04, 30.03, 30.01, 861.02, 861.01, 861.03, 861.52, 861.61, 865.9, 861.04; 141/7, 45, 52, 59, 93, 311 R

[56] References Cited

U.S. PATENT DOCUMENTS 2,772,567 12/1956 Boden et al. ..... 73/861.02

4,138,880 2/1979 Cohen et al. ..... 141/93

4,392,870 7/1983 Chieffo et al. ..... 55/20

FOREIGN PATENT DOCUMENTS 2237937 2/1974 Germany .

OTHER PUBLICATIONS

Automotive Engineering, vol. 84, No. 5, May 1976, pp. 24–29, "Refuelling Emissions Can Be Controlled".

*Primary Examiner*—Hezron E. Williams
*Assistant Examiner*—Michael J. Brock
*Attorney, Agent, or Firm*—Frishauf, Holtz, Goodman, Langer & Chick

[57] ABSTRACT

The efficiency of hydrocarbon vapor recovery installations used in gas stations is measured. A system for measuring a yield of recovery for hydrocarbon vapors emitted from the tank of a vehicle as it is being filled comprises at least one box for carrying a nozzle inside and for placement over a filler neck of the tank. The nozzle is connected through a conduit to a device for evaluating the recovered hydrocarbon vapor, wherein the recovered vapor evaluation device is a gas meter and a following orifice.

5 Claims, 3 Drawing Sheets

SYSTEM FOR MEASURING THE EFFICIENCY OF HYDROCARBON VAPOR RECOVERY INSTALLATIONS USED IN GAS STATIONS

FIELD OF THE INVENTION

This invention concerns a system for measuring the efficiency of hydrocarbon vapor recovery installations used in gas stations and, in particular, to one that is safe, accurate and readily transportable.

BACKGROUND OF THE INVENTION

In order to prevent or limit the emission of hydrocarbon vapors which are normally given off into the surrounding atmosphere when filling the tank of a motor vehicle, several different approaches exist for trapping and recycling the vapors to storage tanks.

The present invention allows the equipment to be transported easily to the site in order to check the operation of fuel dispensers equipped with vapor recovery.

Fuel dispensers are known which are equipped with recuperators integrated into the dispensing nozzles, through which the vapor is either aspirated by means of a pump or else is forced back by a slight excess pressure created in the vehicle fuel tank by the addition of liquid, which displaces the vapor towards the opening.

Measuring and testing equipment has been specifically adapted to these operations, for ensuring that they operate correctly. The laws of some countries require a minimum recuperation yield or efficiency. For example, 80% of the vapor normally dispersed into the atmosphere is to be recovered and fed to the underground storage tank from which the dispensed liquid came.

Two kinds of such yields or efficiencies can be defined:

Volumetric, which is obtained by comparing the volume of returned vapor with the volume of liquid dispensed. The means for determining this efficiency are in general simple enough but they do not account for the actual amount of hydrocarbon recovered, since excess air can be aspirated in place of hydrocarbon vapor.

Mass, which is obtained by comparing the mass of recovered hydrocarbons mixed with air with the mass of hydrocarbons mixed with air which would escape into the atmosphere in the absence of the recovery system.

The means enabling this kind of "mass" efficiency to be determined are much more difficult to realize and require the presence of rather sophisticated equipment.

Thus, the method which consists in checking a mass efficiency necessitates a weighing operation, which requires:

(a) Trapping and aspirating all of the hydrocarbons mixed with air which escape from a filler neck of the vehicle during a filling effected with a conventional nozzle, feeding them through an active carbon cartridge so as to trap them and then performing differential weighing to measure about 60 g of trapped hydrocarbon in a total mass of about 20 kg constituted by the casing containing the carbon filter. The "base" hydrocarbon emission is thus determined.

(b) Repeating the same operation while filling with the nozzle equipped with a recuperator and weighing what the nozzle has failed to aspirate off. The "residual" hydrocarbon emission is thus determined. Since the mass efficiency should be in the order of 80%, it follows that this latter operation involves only a small mass of hydrocarbon, in the order of only 10 g.

It is clear that such a method leads to several difficulties. For example, the vapor mixed with the air can be highly explosive. Therefore, all the equipment, and in particular the active carbon cartridge, has to be capable of resisting an explosion by virtue of its massive construction. In addition, flame traps must be fitted in all of the circuits. Finally, the active carbon can equally well retain atmospheric humidity and the hydrocarbons normally present in the vicinity of fuel pumps, which leads to the use of a supplementary control cartridge, through which a flow of ambient air is passed in order to be able to effect a mass correction by analyzing the air.

Accordingly, the mass efficiency or yield method can only be employed either in a laboratory, with all the constraints which stem from the presence of a vehicle and of explosive vapors, or at an open air site, such as a gas station, provided with a high precision weighing balance, with the attendant problems of having it maintained and protected from the weather.

SUMMARY OF THE INVENTION

An object of the invention is to provide a more accurate measuring system which seeks to overcome the above-described difficulties and which can be used on-site at gas stations.

These and other objects are attained in accordance with one aspect of the present invention that provides a system for measuring efficiency of installations for recovering hydrocarbon vapors while filling the tank of a vehicle, comprising at least one box for housing a nozzle and for placement over a filler neck of the tank, and having a connection via a conduit to an evaluation device for evaluating the recovered hydrocarbon vapor, wherein the recovered vapor evaluation device is a gas meter with a following orifice.

Use of the present invention allows the mass recovery yield or efficiency to be measured accurately, but without reliance upon an active carbon cartridge or upon a precision weighing balance.

The present invention facilitates transport of the system to the site to check the operation of fuel dispensers equipped with vapor recovery, without any precautions.

BRIEF DESCRIPTION OF THE DRAWINGS

Other features and advantages of the invention will appear from the following description, referring to the accompanying drawings, in which.

DETAILED DESCRIPTION OF THE PREFERRED EMBODIMENT

In order to explain the invention better so that it can be more readily understood, it is necessary to take a look at the method and the system of the state of the art.

Figure 1:
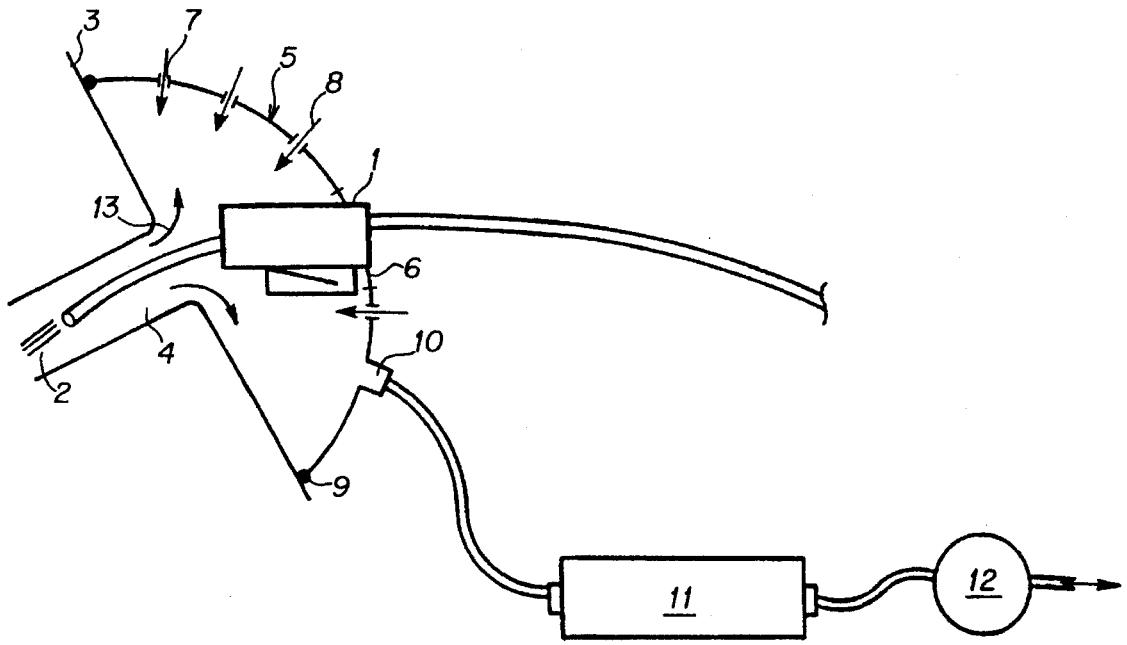
FIG. 1 (PRIOR ART)
FIG. 1 is a diagram of a prior art system for measuring the "base" emission.

In FIG. 1 the measurement principle used by the prior art is shown schematically. A conventional nozzle 1 fills a vehicle tank 2, and a part of the vehicle body 3 around the filler neck 4 is in contact with a box or bag 5 having an opening 6 allowing the nozzle 1 and the hand of an operator to pass therethrough. The box 5 is provided with holes 7 allowing passage of ambient air 8 (as indicated by arrows). A rubber edge 9 is applied to the body 3 and forms a seal. The box 5 has a connection 10 which places its interior in communication with an active carbon filter 11 and a pump 12.

Ambient air 8 is aspirated through the holes 7 when the pump 12 is put into operation and then entrains the vapors 13 (as indicated by the arrows) given off by the neck 4, passing them through the filter cartridge 11, where they are trapped. In practice, for a volume of dispensed liquid fuel of 50 liters for example, the increase in the mass of the cartridge 11 can be measured by weighing, 60 grams for example. The "base" hydrocarbon (HC) emission will then be:

$$\frac{60 \text{ grams HC}}{50 \text{ liters displaced}} = 1.2 \text{ g/liter of vapor}$$

Figure 2:
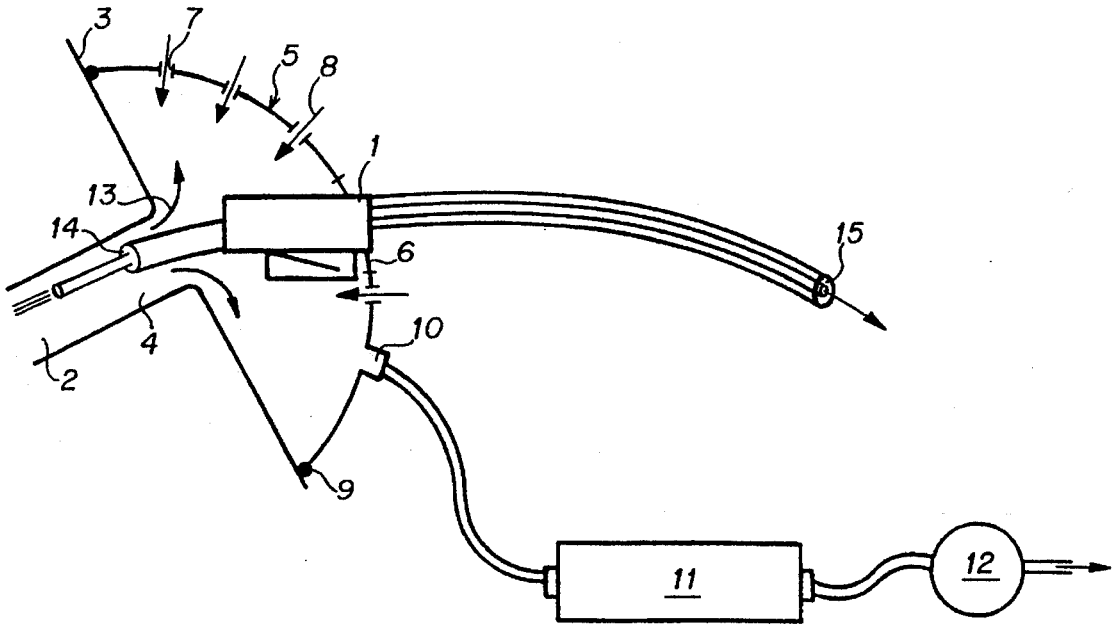
FIG. 2 (PRIOR ART)
FIG. 2 is a diagram of a prior art system for measuring the "residual" emission.

In FIG. 2 a known measurement principle during the phase of determining the "residual" emission is shown schematically.

All the elements 1 to 13 are essentially identical with those of FIG. 1. However, the nozzle is equipped with a vent 14 for aspirating vapors which return to a storage tank (not shown) through a conduit 15 of coaxial type in the hose of the nozzle 1. In this case the amount of hydrocarbon trapped in the cartridge 11 represents only the hydrocarbon which the recuperating nozzle 1 has failed to capture during the filling operation (for example 12 g instead of 60 g) . The "residual" emission then becomes:

$$\frac{12 \text{ grams HC}}{50 \text{ liters}} = 0.24 \text{ g/liter of vapor}$$

The yield or efficiency is thus calculated as:

$$\frac{60-12}{60} = 0.8 = 80\%$$

Figure 3:
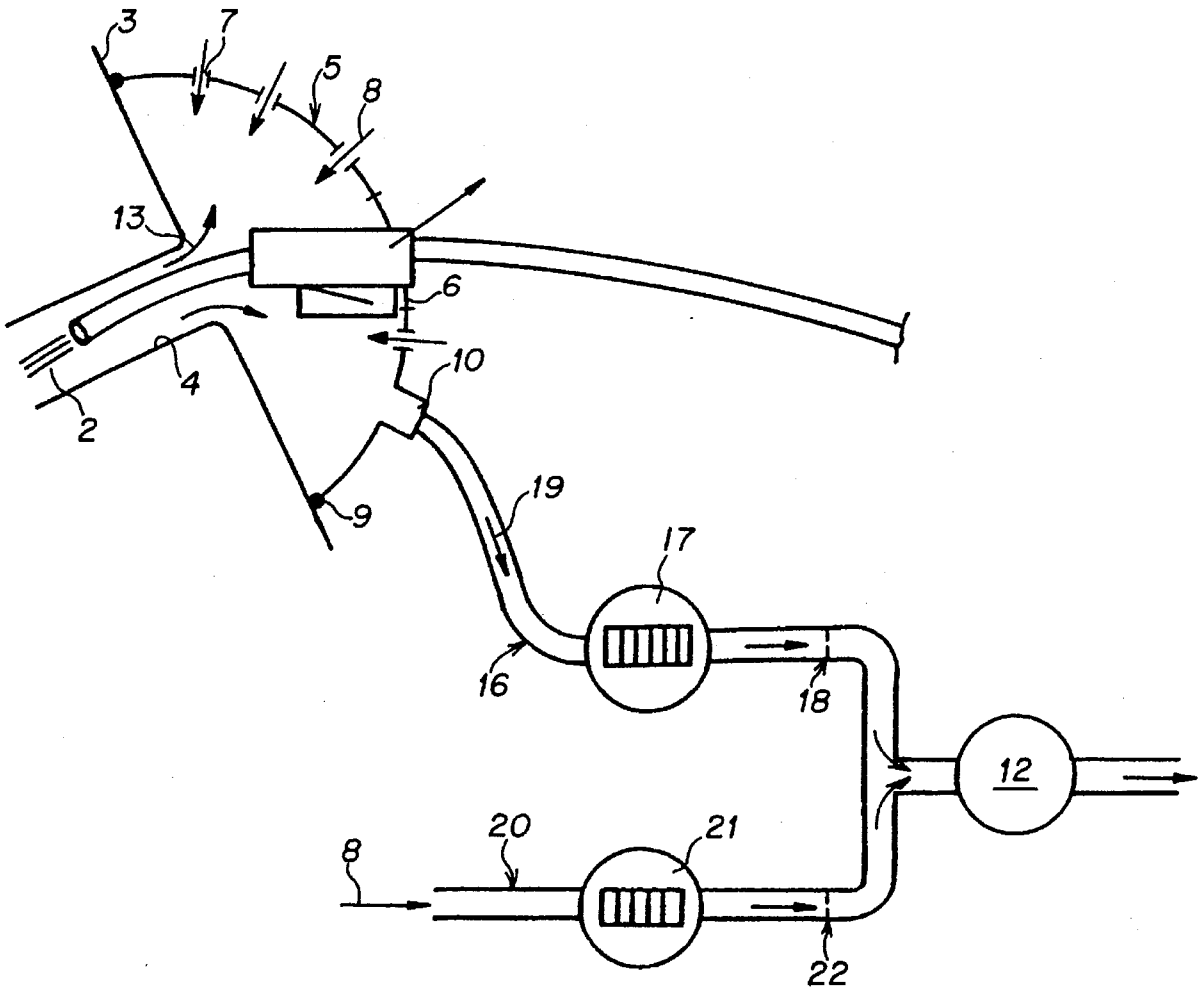
FIG. 3 is a diagram of a preferred embodiment of the system according to the invention.

An apparatus constructed in accordance with the present invention is shown schematically in FIG. 3. All the elements 1 to 13 are identical to those of FIGS. 1 and 2, with the exception of the active carbon cartridge 11, which is replaced by a measuring device comprising:

- A first conduit 16 in which there are connected a first gas meter 17 followed by a first restriction 18 of orifice type, through which the pump 12 aspirates a gaseous mixture 19 to be analyzed (as indicated by an arrow); and
- A second conduit 20 in which there are connected a second gas meter 21 followed by a second restriction 22 of orifice type identical to the first orifice 18 and which is likewise connected to the suction pump 12. This second conduit 20 aspirates ambient air 8 (as indicated by an arrow).

Because of the different densities of vapor which flow therethrough, the volume flow rates of the meters 17 and 21 will be different. The vapor 19 charged with hydrocarbons heavier than air experiences more resistance in passing through the orifice 18 than does the air 8 which passes through the orifice 22. Therefore, the second meter 21 rotates faster than the first meter 17.

During measuring phase I ("base" emission), the density of the vapor which passes through the upper circuit will be $\rho_{base}$ while the lower circuit is traversed by air of density $\rho_O < \rho_{base}$.

The ratio of the volume flows measured by the meters 17 and 21 this time will be:

$$\frac{q_{v_0}}{q_{v_1}} = \sqrt{\frac{\rho_{base}}{\rho_0}} \qquad \rho_{base} = \rho_0 \cdot \frac{q_{v_0}^2}{q_{v_1}^2}$$

During the measuring phase II ("residual" emission), the density of the vapor which passes through the upper circuit will always be $\rho_{resid} \geqq \rho_O$ and the ratio of volume flows measured by the meters 17 and 21 this time becomes:

$$\frac{q_{v_0}}{q_{v_2}} = \sqrt{\frac{\rho_{resid}}{\rho_0}} \qquad \rho_{resid} = \rho_0 \cdot \frac{q_{v_0}^2}{q_{v_2}^2}$$

In order now to ascertain the masses $m_1$ and $m_2$ of just the hydrocarbons as mixed with air and which have passed through the meter 17 during the measurements in phases I and II it is necessary to carry out the two integrations:

$$m_1 = \int_0^{t_1} X_{base} \cdot \rho_{HC} \cdot q_{v_1} \cdot dt$$

and $$m_2 = \int_0^{t_2} X_{resid} \cdot \rho_{HC} \cdot q_{v_2} \cdot dt$$

in which $X_{base}$ and $X_{resid}$ represent in each case the fractions by volume of hydrocarbons in the aspirated mixture 19 and which can be deduced from the two following relations:

$$\rho_{base} = X_{base}\rho_{HC} + (1 - X_{base})\rho_O$$

$$\rho_{resid} = X_{resid}\rho_{HC} + (1 - X_{resid})\rho_O$$

in which $\rho_{HC}$ represents the density of the pure hydrocarbon vapor.

$\rho_{HC}$ is not known apriori, but is constant during the two measuring operations which follow each other, in which:

$$X_{base} = \frac{\rho_{base} - \rho_0}{\rho_{HC} - \rho_0} \quad \frac{\rho_0}{\rho_{HC} - \rho_0} \cdot \left( \frac{q_{v_0}^2}{q_{v_1}^2} - 1 \right)$$

$$X_{resid} = \frac{\rho_{resid} - \rho_0}{\rho_{HC} - \rho_0} \quad \frac{\rho_0}{\rho_{HC} - \rho_0} \cdot \left( \frac{q_{v_0}^2}{q_{v_2}^2} - 1 \right)$$

$$m_1 = \frac{\rho_{HC} \cdot \rho_0}{\rho_{HC} - \rho_0} \cdot \int_0^{t_1} \left( \frac{q_{v_0}^2}{q_{v_1}^2} - 1 \right) \cdot q_{v_1}^2 dt$$

-continued $$m_2 = \frac{\rho_{HC} \cdot \rho_0}{\rho_{HC} - \rho_0} \cdot \int_0^{t_2} \left( \frac{q_{v_0}^2}{q_{v_2}^2} - 1 \right) \cdot q_{v_2}^2 dt$$

The efficiency or yield R is then defined by:

$$R = 1 - \frac{m_2}{m_1} = 1 - \frac{\int_0^{t_2} \left( \frac{q_{v_0}^2}{q_{v_2}^2} - 1 \right) \cdot q_{v_2} dt}{\int_0^{t_1} \left( \frac{q_{v_0}^2}{q_{v_1}^2} - 1 \right) \cdot q_{v_1} dt} =$$

$$1 - \frac{\int_0^{t_2} (q_{v_0} - q_{v_2}) \left( 1 + \frac{q_{v_0}}{q_{v_2}} \right) \cdot dt}{\int_0^{t_1} (q_{v_0} - q_{v_1}) \left( 1 + \frac{q_{v_0}}{q_{v_1}} \right) \cdot dt}$$

which expression is independent of the densities $\rho_O$ and $\rho_{HC}$.

The volume flow $q_v$ can easily be converted into a proportional frequency F. A gasoline pump typically includes a volume meter with a pulse generating encoder which turns with a rotational element responsive to flow to transform such rotation into pulses which are proportional to measured flow. The most common encoders (or pulse sources) are of the optical type, but other types are also well known. The preferred embodiment utilizes a flow meter available from Schlumberger Industries, S.A. in France under the brand name DELTA. Thus, it is possible to automate the measuring system to effect operations to determine $q_v$ by $$\int_0^t \left( \frac{F_0^2}{F_1^2} - 1 \right) \cdot F_1 dt$$

This can be done by means of small computers which display the resulting integrated value.

Some particular features of the method are:

There is no direct access to the masses $m_1$ and $m_2$, since $\rho_{HC}$ is not known apriori, but only to their ratio m1/m2, which determines the yield or efficiency R.

If however it is desired to know the masses of hydrocarbons entrained in the gaseous flow, it is necessary to ascertain the value of the expression:

$$\frac{\rho_0 \cdot \rho_{HC}}{\rho_{HC} - \rho_0}$$

$\rho_O$ relates to the air; its value can be calculated or measured with a gas densimeter and will be around 1.2 kg/m$^3$.

$\rho_{HC}$ relates to the pure hydrocarbon; its value can equally be measured with a densimeter, but it is possible to get an approximate value rapidly, since $$\frac{\rho_{HC}}{\rho_{HC} - \rho_0}$$

becomes approximately $$\frac{M_{HC}}{M_{HC} - 28.9}$$

with $M_{HC}$=65 g/mole in winter, whence $$\frac{\rho_0 \cdot \rho_{HC}}{\rho_{HC} - \rho_0} = 2.16 \text{ kg} \cdot \text{m}^{-3}$$

and with $M_{HC}$=67 g/mole in summer, whence $$\frac{\rho_0 \cdot \rho_{HC}}{\rho_{HC} - \rho_0} = 2.11 \text{ kg} \cdot \text{m}^{-3}$$

The integration time interval does not play any part if it exceeds the duration of vapor emission. Thus, if the measurement is carried on too long, $F_1$ and $F_2$ both tend with time to $F_O$ (aspiration of pure air) and the corresponding integration comes to zero.

Correction to take account of the humidity of the ambient air is effected automatically.

Figure 4:
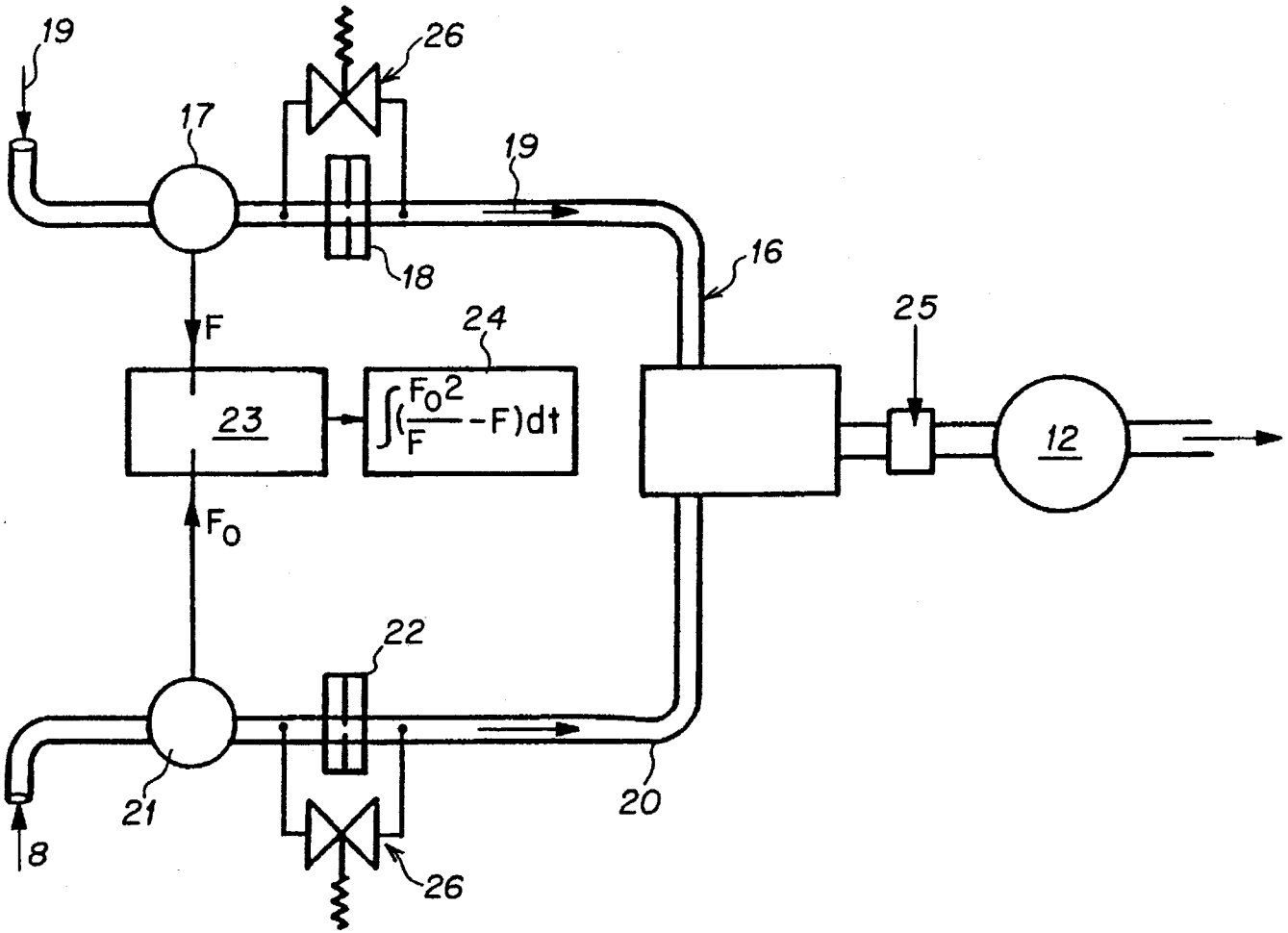
FIG. 4 is a diagram showing more details of the apparatus shown in FIG. 3.

As is shown in FIG. 4, one of the possible embodiments of a system of the invention as shown in FIG. 3 comprises meters 17 and 21, preferably of rotary piston type, provided with generators of pulse signals F and Fo. They provide, for example, one pulse per 10 cm$^3$ of gas metered. The signals F and Fo are fed to a small computer 23 and then to a display integrator 24. The two orifices 18, 22 will be identical, allowing 50 l of vapor per minute to flow with a loss of head (vacuum determined by the regulator 25) in the order of 50 mbar.

Final valve regulating means 26 allow the circuits to be adjusted in such a manner that there is initially the same pulse frequency when the two meters 17 and 21 both aspirate ambient air.

It will be understood that the first conduit 16 is directly coupled to the union 10 of a box 5, as shown in FIG. 3, to receive gaseous mixture 19.

It will be understood that such an assembly, which requires only rugged and tested equipment, can be mounted on a chassis for easy transport, without precautions, for on-site testing.

One characteristic of the present invention is the replacement of a weighing operation by an operation which measures mass flow through the association of two measuring devices, namely, an orifice plate 18 (see FIG. 3) and an orifice differential pressure gauge 22 (see FIG. 4) which provide values of the densities $\rho_{base}$ and $\rho_{resid}$ in an indirect manner.

The direct measurement of these parameters by a gas densimeter allows the same desired result to be obtained. Thus, in order not to give the method a limiting character, the invention also provides for implementation by the use of a densimeter associated with a volumetric meter. By measuring the density of the air, $\rho_O$, then $\rho_{base}$ and $\rho_{resid}$ during the two successive operations and integrating each time $$\int(\rho_{base} - \rho_O) q_{v_1} dt \text{ and } \int(\rho_{resid} - \rho_O) q_{v_2} dt$$

the same result is obtained:

$$R = 1 - \frac{\int(\rho_{resid} - \rho_0)q_{v_2}dt}{\int(\rho_{base} - \rho_0)q_{v_1}dt}$$

We claim:

1. A system for measuring the relative mass efficiency of installations for recovering hydrocarbon vapors while filling the tank of a vehicle, comprising:

one box for housing a nozzle and for placement over a filler neck of the tank, a first conduit connected at one end to said box and at a second end to a pump provided for withdrawing hydrocarbon vapor mixed with air from said box, said first conduit having a first restriction and a first gas flow meter provided for measuring flow $q_v$ of said hydrocarbon vapor mixed with air, a second conduit opened at one end to ambient air and at a second end to said pump, said second conduit having a second restriction, identical to said first restriction, and a second gas flow meter provided for measuring flow $q_{vo}$ of ambient air, means for calculating the integral $$i = \int_0^t (q^2_{vo}/q^2_v - 1)q_v dt$$

from the values of flows $q_v$ and $q_{vo}$ respectively measured by said first and second gas flow meters.

2. A system according to claim 1, further comprising regulating means to initially adjust said first and second conduits in such a manner that said first and second flows $q_v$ and $q_{vo}$ are equal when both aspirate ambient air.

3. A system according to claim 1, wherein each of the first and second gas flow meters is provided with a pulse generator.

4. A system according to claim 3, wherein each of the first and second gas flow meters is a rotary piston type.

5. A method for measuring the mass relative efficiency of installations for recovering hydrocarbon vapors while filling the tank of a vehicle, said method being performed with a system according to claim 1, and comprising the steps of:

calculating a first integral $$il = \int_o^{t_1} (q^2_{vo}/q^2_{v1} - 1)q_{v1}dt$$

wherein $q_{v1}$ is flow of hydrocarbon vapors mixed with air withdrawn from said box during a filling effected with a conventional nozzle during time $t_1$, calculating a second integral $$i_2 = \int_o^{t_2} (q^2_{vo}/q^2_{v2} - 1)q_{v2}dt$$

wherein $q_{v2}$ is flow of hydrocarbon vapors mixed with air withdrawn from said box during a filling effected with a nozzle equipped with a recuperator during time t2, and calculating said mass relative efficiency R by $$R = 1 - i_2/i_1.$$

* * * * *